US005438400A

United States Patent [19]

Kuribayashi et al.

[11] Patent Number: 5,438,400

[45] Date of Patent: Aug. 1, 1995

[54] IMAGE FORMING APPARATUS HAVING CLEANING BLADE WITH SURFACE COATED LAYER AT A TIP END THEREOF

[75] Inventors: Ikuo Kuribayashi, Tokyo; Rie Saito, Yokohama, both of Japan

[73] Assignee: Canon Kabushiki Kaisha, Tokyo, Japan

[21] Appl. No.: 128,101

[22] Filed: Sep. 29, 1993

[30] Foreign Application Priority Data

Sep. 30, 1992 [JP] Japan ..... 4-283424

[51] Int. Cl.[6] ..... G03G 21/00

[52] U.S. Cl. ..... 355/299; 15/256.5

[58] Field of Search ..... 355/296, 299; 15/1.51, 15/256.5, 256.51; 118/652; 430/125

[56] References Cited

U.S. PATENT DOCUMENTS 5,145,724 9/1992 Yanai et al. ..... 355/299 X 5,211,864 5/1993 Godlove ..... 355/299 X

FOREIGN PATENT DOCUMENTS 0460658 12/1991 European Pat. Off. ..... 355/299

53-74435 7/1978 Japan ..... 355/299

*Primary Examiner*—William J. Royer

*Attorney, Agent, or Firm*—Fitzpatrick, Cella, Harper & Scinto

[57] ABSTRACT

An image forming apparatus including a rotating image bearing member, and a cleaning blade having a surface coating layer to be abutted against the image bearing member for removing residual toner from the image bearing member. The surface coating layer has a coating material bead at a position out of a tip end of the cleaning blade, and a distance between the coating material bead and the tip end of the cleaning blade is greater than a width of an abutment area between the image bearing member and the cleaning blade.

14 Claims, 5 Drawing Sheets

IMAGE FORMING APPARATUS HAVING CLEANING BLADE WITH SURFACE COATED LAYER AT A TIP END THEREOF

BACKGROUND OF THE INVENTION

1. Field of the Invention

The present invention relates to an image forming apparatus of electrophotographic type such as a copying machine, a laser beam printer and the like.

2. Related Background Art

Image forming apparatuses wherein, after a toner image formed on a moving image bearing member is transferred to a transfer material, then residual toner not transferred to the transfer material and remaining on the image bearing member is cleaned and such cleaning operation is repeated, are well known. In such an image forming apparatus, in order to remove the residual toner, a cleaning blade made of elastic material such as urethane rubber has been widely used as a cleaning means for removing the residual toner, since it is compact and is simple in construction, which leads to make the apparatus inexpensive.

An example of one of such conventional cleaning devices is shown in FIG. 6.

A cleaning device 8 extending in a direction perpendicular to the plane of FIG. 6 is arranged in parallel with and in the proximity of an image bearing member 2 rotated in a direction shown by the arrow. The cleaning device 8 includes a cleaning blade 13 a free end of which is urged against a surface of the image bearing member to scrape and remove the residual toner generated at a transfer station and reached to a cleaning station. The removed toner is guided by a dip sheet 10 to reach a toner reservoir portion of the cleaning device and then is discharged from the reservoir portion by a convey screw 14. Incidentally, it should be noted that elements for forming an image such as a primary charger, an image signal applying means, a developing device, a transfer means and the like are arranged around the image bearing member 2.

However, since the residual toner remaining on the image bearing member has a charge, the toner is adhered to the surface of the image bearing member by a strong electrostatic absorption force. Thus, since the cleaning blade must remove the toner particles from the surface of the image bearing member while overcoming the electrostatic absorption force of the toner particles to the image bearing member, the cleaning blade must be urged against the surface of the image bearing member with a strong force. In addition, in many cases, the cleaning blade is urged against the surface of the moving image bearing member with the free end (edge) thereof directed toward a direction resisting the movement of the image bearing member, with the result that the great friction force is generated between the blade edge and the image bearing member. The toner scraped from the image bearing member by the blade acts as the lubricant between the image bearing member and the blade edge, thereby reducing the friction force. In fact, however, the blade and/or the image bearing member were worn, or sometimes, the edge of the blade was turned up in the rotational direction of the image bearing member.

To eliminate such inconvenience, various techniques in which coating material having a coefficient of friction small than that of the cleaning blade is coated on the surface of the cleaning blade have been proposed (for example, refer to U.S. Ser. Nos. 710,772 and 059,852).

As methods for applying the liquid coating material on the surface of the blade, there are a method for spraying the coating material on the blade surface, a method for dipping the blade into the coating material contained in a bath and the like. Although such methods have advantages and disadvantages, the cleaning blade manufactured by the dipping method has been widely used, because it is important to maintain the flatness of the coated surface of the cleaning blade and such flatness can relatively be easily obtained by the dipping method.

In the cleaning blade manufacturing method using the dipping coating technique, for example, after a cleaning blade made of urethane rubber is dipped into the solution including nylon resin and alcohol, the blade is dried to evaporate the alcohol, thereby forming the nylon coating layer on the surface of the blade. When the cleaning blade having the surface coating layer is manufactured in this way, as shown in FIG. 5, a bead a of the coating material is formed on the edge portion of the blade. To eliminate such coating material bead a, as shown in FIG. 5, the edge portion of the blade is cut off. In this way, the accuracy of the edge of the blade is obtained.

However, the inventors found that, as shown in FIG. 5, a bead of the coating material was also formed slightly in a position b on the blade surface out of the blade edge. Although the size of such bead b differs depending upon the dipping condition, in the actual measurement, it was found that such bead had a height of about several microns and a width of 600 microns at the maximum. If such bead b is abutted against the surface of the image bearing member, since flatness of the blade cannot be maintained, the cleaning ability will be worsened.

SUMMARY OF THE INVENTION

The present invention intends to eliminate the above-mentioned conventional drawback, and has an object to provide an image forming apparatus wherein a width of the abutment area between a cleaning blade and an image bearing member is uniform along the whole length of the cleaning blade.

Another object of the present invention is to provide an image forming apparatus wherein an abutment pressure between a cleaning blade and an image bearing member is uniform along the whole length of the cleaning blade.

A further object of the present invention is to provide an image forming apparatus wherein a bead of coating material formed on a cleaning blade is not contacted with an image bearing member.

A still further object of the present invention is to provide an image forming apparatus wherein a distance between a bead of coating material formed on a cleaning blade and a tip end of the cleaning blade is greater than a width of the abutment area between the cleaning blade and an image bearing member.

The other objects of the present invention will be apparent from the following detailed description referring to the accompanying drawings.

DETAILED DESCRIPTION OF THE PREFERRED EMBODIMENTS

Figure 1:
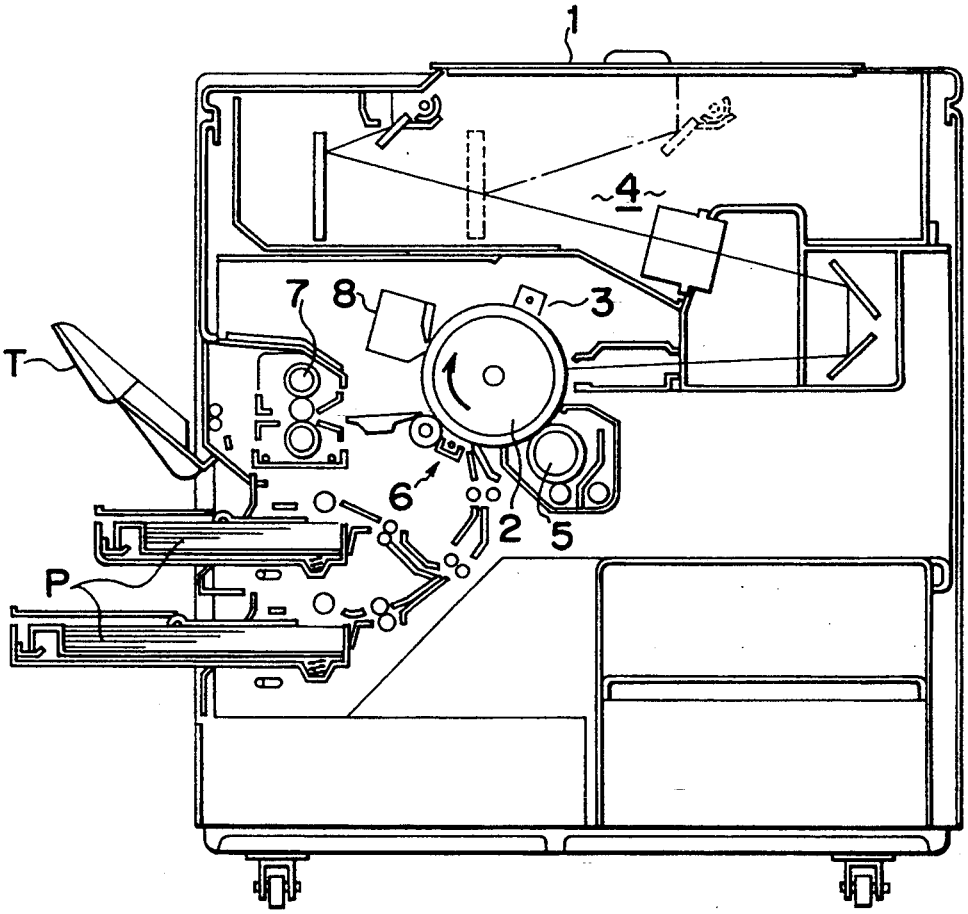
FIG. 1 is a schematic elevational sectional view of an image forming apparatus according to a first embodiment of the present invention.

FIG. 1 is a schematic constructural view of an image forming apparatus according to a preferred embodiment of the present invention.

After an original is rested on an original support 1, when a copy start button (not shown) is depressed, a surface of a photosensitive drum (image bearing member) 2 is uniformly charged by a charger 3. Light reflected from the original on the original support 1 is directed to the charged surface of the photosensitive drum 2 by an optical system 4, thereby forming an electrostatic latent image on the photosensitive drum. The latent image formed on the photosensitive drum 2 is developed with toner by a developing device 5, thereby forming a toner image.

Thereafter, the toner image formed on the photosensitive drum 2 is transferred onto a recording sheet P by a transfer charger 6. Then, the toner image transferred to the recording sheet P is fixed by a fixing device 7. Thereafter, the recording sheet is discharged onto a sheet discharge tray T. After the toner image has been transferred to the recording sheet, the surface of the photosensitive drum 2 is cleaned by a cleaning device 8 to remove the residual toner remaining on the photosensitive drum.

Figure 2A:
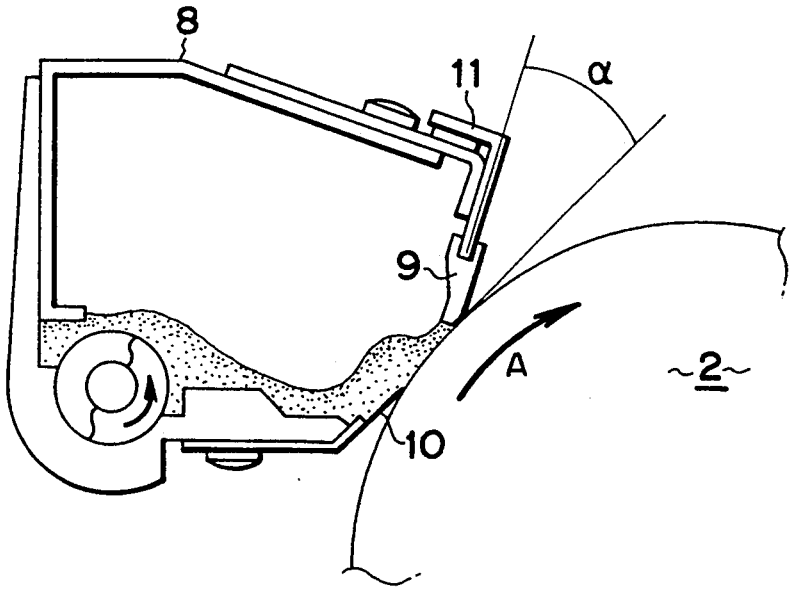
FIG. 2A is a sectional view showing an operation of a cleaning blade of the image forming apparatus of FIG. 1.
Figure 2B:
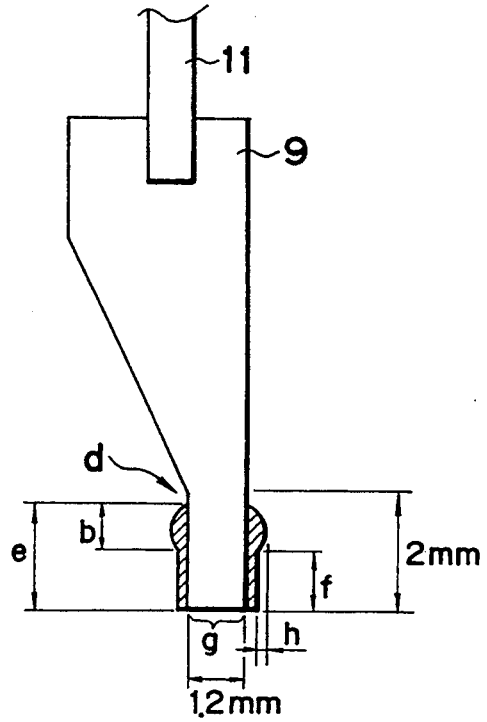
FIG. 2B is an enlarged sectional view of the cleaning blade.
Figure 2C:
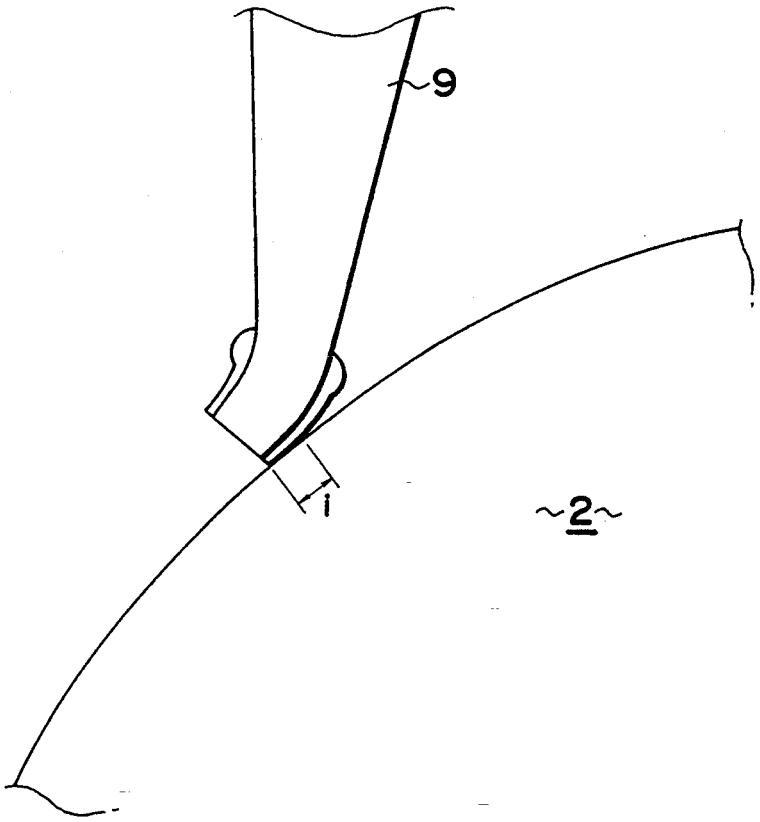
FIG. 2C is an enlarged view showing an abutment area between the cleaning blade and a photosensitive drum.

FIGS. 2A–2C schematically shows the cleaning device as a cleaning means. The cleaning device 8 is abutted against the photosensitive drum 2 rotated in a direction shown by the arrow A in such a manner that a cleaning blade 9 of the cleaning device 8 is abutted against the surface of the photosensitive drum 2 from a direction opposite to a rotational direction of the photosensitive drum 2. On the other hand, the residual toner not transferred to the recording sheet at a transfer station and remaining on the surface of the photosensitive drum 2 reaches the cleaning device 8, where the residual toner is scraped from the surface of the photosensitive drum 2 by the cleaning blade 9 and is dropped onto a dip sheet 10.

However, since the residual toner remaining on a photosensitive drum has the charge, the toner particles are adhered to the surface of the photosensitive drum by the electrostatic absorption force. Accordingly, in case of the cleaning device as shown in FIG. 2A, since the cleaning blade 9 must remove the toner particles from the surface of the photosensitive drum while overcoming the electrostatic absorption force of the toner particles to the photosensitive drum, the cleaning blade must be abutted against the drum surface with a strong force.

In addition, in the past, although the cleaning blade was mainly made of urethane rubber in consideration of the resistance to medicine, wear resistance, molding ability and mechanical strength, for example, a coefficient of friction between the cleaning blade made of urethane rubber and an OPC photosensitive drum having a surface layer made of high-molecular resin such as polycarbonate is extremely high. Thus, in such combination, a great friction force is generated between the photosensitive drum and the cleaning blade, with the result that the cleaning blade is turned up in the rotational direction of the photosensitive drum, thereby stopping the photosensitive drum and/or making the cleaning impossible.

To avoid this, the friction force between the cleaning blade and the photosensitive drum is reduced by applying a coating material on the surface of the cleaning blade, thereby preventing the turn-up of the blade to perform the effective cleaning operation.

Further, by uniformly dispersing lubricant particles in the solvent, the friction force between the drum and the blade can be further reduced, thereby preventing the turn-up of the blade more effectively. By using lubricant particles of non-fixed form, since the mechanical sticking force due to the anchoring effect is added to the binder resin forming the coating layer to form the stable coating layer, the lubricant particles are more difficult to be separated from the coating layer, with the result that the coefficient of friction at the blade edge can be maintained in a lower stable condition.

In the illustrated embodiment, the cleaning blade was manufactured by dipping a blade made of urethane rubber having Young's modulus of 35 to 60 kgf/cm$^2$ into nylon resin solution dispersing graphite fluoride powder (an amount of 5 to 50 weight %) and then by drying and heating the blade to cure the coating material. Since a bead of the coating material was formed on an edge portion of the blade, the edge portion on which the coating material bead was formed was cut off.

The graphite fluoride dispersed in the nylon resin solution may be, for example, "SEFBON DM" of (C2F)n type (manufactured by Central Glass Co., Ltd. in Japan), "SEFBON CMA" of (CF)n type (manufactured by Central Glass Co., Ltd. in Japan), "SEFBON CMF" of (CF)n type (manufactured by Central Glass Co., Ltd. in Japan), carbon fluoride #2065, #1030 and #1000 (manufactured by Asahi Glass Co., Ltd. in Japan), CF-100 (manufactured by Nihon Carbon in Japan), carbon fluoride #2028 and #2010 (manufactured by Asahi Glass Co., Ltd. in Japan) of (CF)n type in which the fluoridizing ratio is changed, or graphite fluoride which is treated by base such as amine to remove fluorine from the surface of the graphite fluoride. However, the graphite fluoride is not limited to such examples. Further, the average diameter of particles in the graphite fluoride is 20 μm or less, and is preferably 1 to 8 μm in order not to worsen the cleaning ability for the toner.

Although the modulus of elasticity of this resin coating layer is changed in accordance with the kind of nylon and an amount of the dispersed fluorocarbon, since the Young's modulus is great such as 3500 to 6000 kgf/cm$^2$ and is greater than that of the urethane rubber forming the blade by about 100 times, the coating layer is very hard. Thus, it is desirable that the coating layer is formed on the cleaning blade only in the proximity of a nip between the blade and the photosensitive drum.

In the illustrated embodiment, the cleaning blade 9 manufactured in the above-mentioned method is abutted against the photosensitive drum 2 at an abutment angle $\alpha$ (an angle between a blade supporting member 11 (FIG. 2A), and a flat contact plane between the cleaning blade and the photosensitive drum including the abutment portion of the photosensitive drum) of 25 degrees and with an abutment pressure of 20 g/cm. Incidentally, in order to effect a good cleaning operation, it is preferable that the abutment angle $\alpha$ is set within a range of 24 to 30 degrees and the abutment pressure is set within a range of 15 to 40 g/cm.

However, as shown in FIG. 2B, a bead b of coating material is formed in the coating layer, other than the edge portion of the cleaning blade. This coating material bead b is not uniform in a longitudinal direction of the blade (maximum difference in height h: 30 $\mu$m, maximum difference in width b: 600 $\mu$m). If the coating material bead b is abutted against the photosensitive drum, the abutment pressure between the blade and the photosensitive drum will be uneven in the longitudinal direction of the blade, thereby worsening the cleaning ability.

To avoid this, in the present invention, a width or distance (f in FIG. 2B) between a tip end of the blade and the coating material bead b is greater than a width (i in FIG. 2C) of a contact area between the photosensitive drum and the blade.

In the illustrated embodiment, the coating material is applied on the surface of the cleaning blade 9 as shown in FIG. 2B in such a manner that a width e of the coating material becomes 0.7 mm or more. When such blade is used, the width i of the abutment portion (nip) between the blade and the photosensitive drum was 0.1 mm or less. Further, since the width b in FIG. 2B is 0.6 mm at the maximum, when the total width e of the coating layer is 0.7 mm or more, the flat portion of the coating layer (f in FIG. 2C) can be abutted against the photosensitive drum.

Further, the cleaning blade according to the illustrated embodiment has the configuration that the blade is difficult to be permanently deformed. That is to say, the stress can easily be dispersed at a portion d to avoid the concentration of the force at one point. Thus, depending upon the fact as to whether the coating layer reaches the portion d or not, the elasticity of the cleaning blade is greatly changed. If the width of the coating layer is greater than 2 mm, since the coating layer covers the portion d (FIG. 2B), a pressure greater than the desired abutment pressure will be applied to the photosensitive drum.

Therefore, when the coating layer is formed on the cleaning blade having the configuration according to the illustrated embodiment in order to perform the effective cleaning operation without changing the elasticity of the blade itself greatly, it is desirable that the width e of the coating layer is greater than 0.7 mm and smaller than 2 mm.

Next, a second embodiment wherein the configuration of the urethane rubber differs from that of the first embodiment will be explained with reference to FIG. 3.

Figure 3:
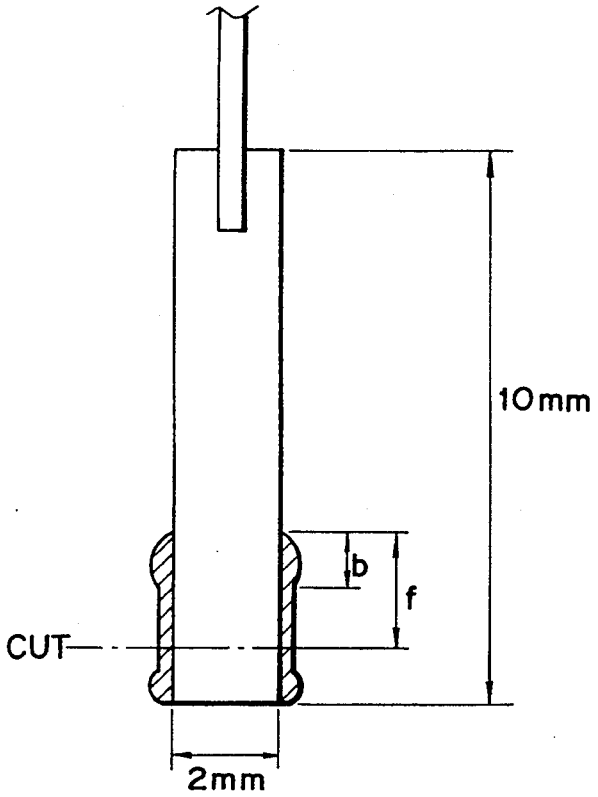
FIG. 3 is an enlarged sectional view of a cleaning blade of an image forming apparatus according to a second embodiment of the present invention.

In this second embodiment, the liquid coating material similar to that in the first embodiment is coated on a surface of cleaning blade as shown in FIG. 3 by the dipping technique in such a manner that a width f of the coating layer becomes 0.8 mm or more. The blade has a urethane portion having a thickness of 2 mm and a length of about 10 min.

When such blade is used, a width of the nip (abutment area) between the blade and the photosensitive drum was about 0.2 mm or less. Further, since a bead b (FIG. 3) of the coating material is also formed on the blade surface in the same manner as the first embodiment, a width of the coating material bead becomes 0.6 mm or less. Thus, the total width f of the coating layer on the blade must be 0.8 mm or more.

In the above first and second embodiments, since the coating layer is formed from the resin, the coating layer is greatly harder than the urethane rubber. Thus, it is desirable that the thickness of the coating layer is reduced since the elasticity of the blade itself is not worsened. Further, when the thickness of the coating layer is reduced, since the coating material bend also becomes smaller, the blade can more easily be abutted against the photosensitive drum.

However, if the coating layer is too thin, the border between the urethane rubber and the coating layer is likely to be contacted with the toner layer electrostatically and strongly adhered to the surface of the photosensitive drum. In this case, the coating layer is apt to be separated from the urethane rubber.

To avoid this, according to a third embodiment of the present invention, a thickness of a coating layer is greater than the average diameter of the toner particles.

Figure 4:
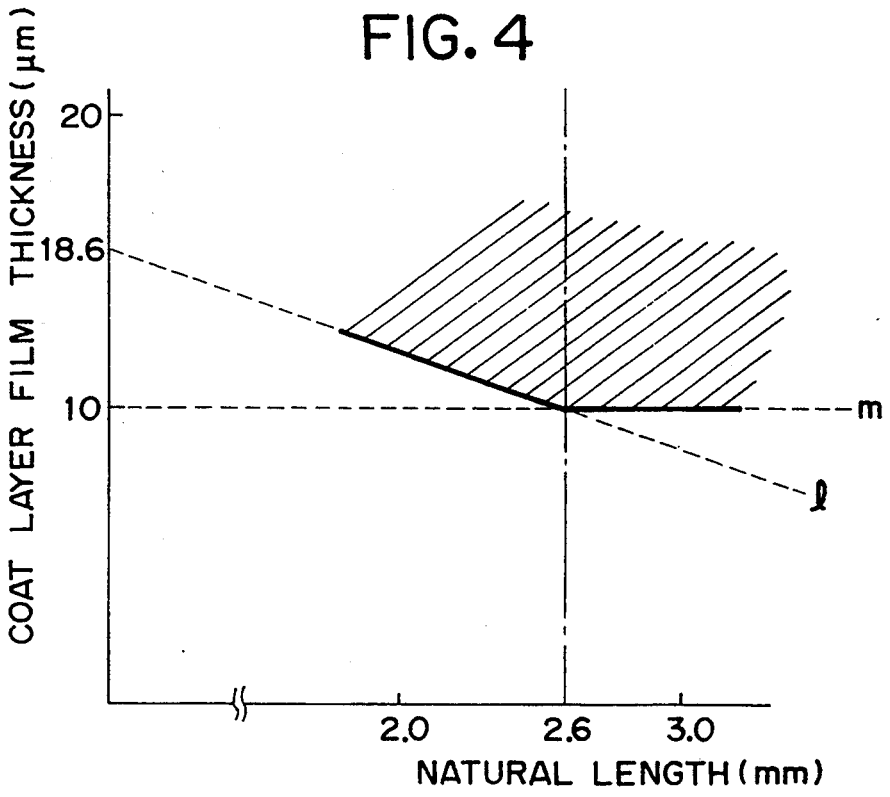
FIG. 4 is a graph showing a relation between a free length of a cleaning blade and a thickness of a coating layer in an image forming apparatus according to a third embodiment of the present invention.
Figure 5:
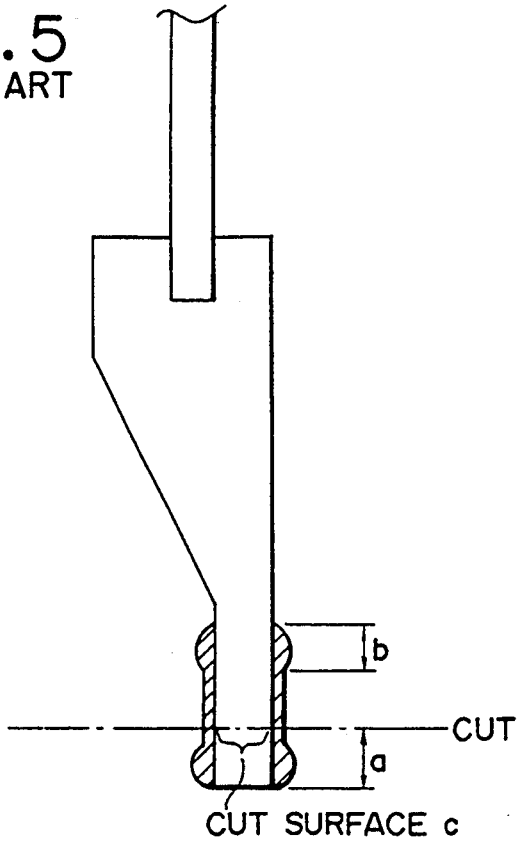
FIG. 5 PRIOR ART
FIG. 5 is a sectional view of a conventional cleaning blade.
Figure 6:
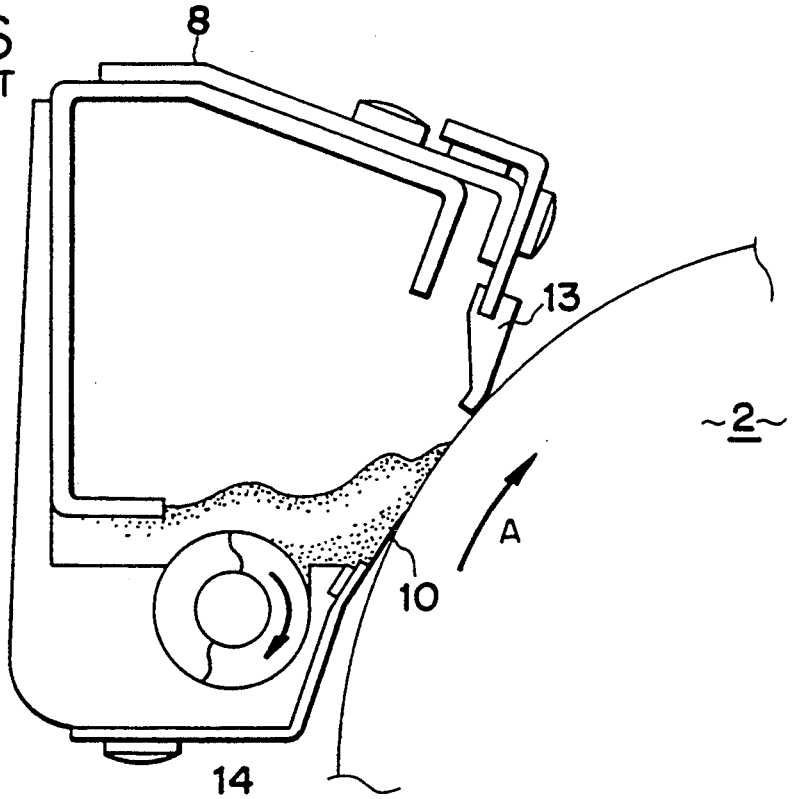
FIG. 6 PRIOR ART
FIG. 6 is a sectional view showing an operation of the cleaning blade of FIG. 5.

Now, a relation between a free length of the cleaning blade (a length between a portion where the stress is concentrated (portion d in FIG. 2B) and the tip end of the blade) and the thickness of the coating layer is shown in FIG. 4.

The average diameter of the toner particles presently used in copying machines is about 6 to 10 $\mu$m, and, therefore, the thickness of the coating layer must be at least 10 $\mu$m or more. Further, if the free length of the blade is decreased, since the width of the abutment area between the blade and the photosensitive drum is decreased accordingly (that is, the abutment angle between the tip end of the blade and the photosensitive drum is increased), it is greatly feared that the urethane rubber portion of the blade is directly contacted with the photosensitive drum so as to turn up the blade. Thus, when the free end of the blade is decreased, it is desirable that the thickness of the coating layer is increased accordingly to avoid the direct contact between the urethane rubber portion of the blade and the photosensitive drum. The relation for preventing the separation of the coating layer and the turn-up of the blade is shown in a hatched area in FIG. 4.

As mentioned above, the thickness of the coating layer must have a value greater than the line m in FIG. 4 in order to prevent the separation of the coating layer from the urethane rubber. Further, the thickness of the coating layer preferably has a value greater than the line l in FIG. 4 in order to prevent the turn-up of the blade. The hatched area in FIG. 4 satisfies these conditions.

In the cleaning blade used in this embodiment (similar to the cleaning blade in the first embodiment), a free length of a cross point between the lines l and m was 2.6 mm. Thus, the thickness of the coating layer can be expressed by the following relations:

(i) When the free length $\leqq$2.6 mm thickness of coating layer (μm) ≧18.6−3.3 ×(free length) (mm)

(ii) When the free length ≦2.6 mm thickness of coating layer (μm) ≦10 μm

As mentioned above, according to the present invention, since the distance between the coating material bead on the surface of the cleaning blade and the tip end of the blade is greater than the width of the abutment area between the image bearing member and the blade, the coating material bead is not directly contacted with the image bearing member, thereby achieving the excellent cleaning ability.

It should be noted that the present invention is not limited to the above-mentioned embodiments and various alterations can be made within the scope of the present invention.

What is claimed is:

1. An image forming apparatus for forming an image onto a recording medium, comprising:

an image bearing body; and a cleaning blade abutting against said image bearing body for removing a toner remaining on said image bearing body, said cleaning blade having a surface coated layer at a tip end abutting against said image bearing body, said surface coated layer having a liquid drip portion at a portion remote from the tip end of said cleaning blade, wherein a width from said liquid drip portion to the tip end of said cleaning blade is larger than a width of an area where said cleaning blade contacts said image bearing body, so that said liquid drip portion does not abut against said image bearing body when said cleaning blade is abutted against said image bearing body.

2. An image forming apparatus according to claim 1, wherein said cleaning blade is made of urethane rubber and said surface coated layer is formed from a nylon layer.

3. An image forming apparatus according to claim 2, wherein said nylon layer is formed by coating nylon resin liquid dissolved by alcohol on said cleaning blade by a dipping method and then by evaporating the alcohol.

4. An image forming apparatus according to claim 1, wherein a surface of said cleaning blade between said liquid drip portion and the tip end of said cleaning blade is substantially flat.

5. An image forming apparatus according to claim 1, wherein a thickness of said surface coated layer is greater than an average diameter of toner particles to be used.

6. An image forming apparatus, comprising:

a rotating image bearing member; and a cleaning blade having a surface coating layer to be abutted against said image bearing member for removing residual toner from said image bearing member;

wherein said surface coating layer has a coating material bead at a position away from a tip end of said cleaning blade, and a distance between said coating material bead and the tip end of said cleaning blade is greater than a width of an abutment area between said image bearing member and said cleaning blade, and wherein a thickness of said surface coating layer is greater than an average diameter of toner particles to be used.

7. An image forming apparatus according to claim 6, wherein said cleaning blade is made of urethane rubber and said surface coating layer is formed from a nylon layer.

8. An image forming apparatus according to claim 7, wherein said nylon layer is formed by coating nylon resin liquid dissolved by alcohol on said cleaning blade by a dipping method and then by evaporating the alcohol.

9. An image forming apparatus according to claim 6, wherein a surface of said cleaning blade between said coating material bead and the tip end of said cleaning blade is substantially flat.

10. A cleaning apparatus for use with an image forming apparatus, for removing a toner left on an image bearing body therefrom, said cleaning apparatus comprising:

a cleaning blade abutting against the image bearing body for removing a toner remaining on the image bearing body, said cleaning blade having a surface coated layer at a tip end abutting against the image bearing body, said surface coated layer having a liquid drip portion at a portion remote from the tip end of said cleaning blade, wherein a width from said liquid drip portion to the tip end of said cleaning blade is larger than a width of an area where said cleaning blade contacts the image bearing body so that said liquid drip portion does not abut against the image bearing body when said cleaning blade is abutted against the image bearing body.

11. A cleaning apparatus according to claim 10, wherein said cleaning blade is made of urethane rubber and said surface coated layer is formed from a nylon layer.

12. A cleaning apparatus according to claim 11, wherein said nylon layer is formed by coating nylon resin liquid dissolved by alcohol on said cleaning blade by a dipping method and then by evaporating the alcohol.

13. A cleaning apparatus according to claim 10, wherein a thickness of said surface coated layer is greater than an average diameter of toner particles to be used.

14. A cleaning apparatus according to claim 10, wherein a surface of said cleaning blade between said liquid drip portion and the tip end of said cleaning blade is substantially flat.

* * * * *